United States Patent [19]

Wolfe

[11] Patent Number: 4,835,667

[45] Date of Patent: May 30, 1989

[54] THERMAL PROTECTOR DEVICE FOR A LIGHTING UNIT

[75] Inventor: Denis Wolfe, Danville, Calif.

[73] Assignee: Prescolite, Inc., San Leandro, Calif.

[21] Appl. No.: 62,092

[22] Filed: Jun. 15, 1987

[51] Int. Cl.[4] ..... F21V 25/10

[52] U.S. Cl. ..... 362/276; 362/364; 362/802; 362/295

[58] Field of Search ..... 362/96, 276, 364, 373, 362/148, 150, 294, 802, 295; 361/105; 337/113, 381; 315/112, 149, 158, 159, 150, 151

[56] References Cited

U.S. PATENT DOCUMENTS

| | | | |
|---|---|---|---|
| 4,216,411 | 8/1980 | Ehret et al. | 362/802 |
| 4,388,677 | 6/1983 | Druffel | 362/364 |
| 4,460,944 | 7/1984 | Gordbegli et al. | 362/373 |
| 4,536,817 | 8/1985 | Pejouhy | 361/105 |
| 4,566,057 | 1/1986 | Druffel | 362/364 |
| 4,635,172 | 1/1987 | Steinke | 362/276 |
| 4,685,037 | 8/1987 | Akiyama et al. | 362/373 |
| 4,751,624 | 6/1988 | Russo et al. | 362/802 |

*Primary Examiner*—Ira S. Lazarus
*Assistant Examiner*—D. M. Cox
*Attorney, Agent, or Firm*—Bielen & Peterson

[57] ABSTRACT

A device for detecting the level of heat generated by a lighting unit utilizing a sleeve possessing an end portion positioned adjacent to the exterior of the housing, an interior portion, and an exterior portion. A thermal protector is positioned at the interior portion of the sleeve at a selected distance from the exterior of the housing. Air is circulated between the exterior portion of the sleeve and the interior portion of the sleeve.

12 Claims, 1 Drawing Sheet

THERMAL PROTECTOR DEVICE FOR A LIGHTING UNIT

BACKGROUND OF THE INVENTION

The present invention relates to a novel device for detecting the level of heat generated by a lighting unit.

Recessed lighting fixtures, although aesthetically pleasing, possess a potential for igniting a fire within the structural body supporting the same. Recently, governmental authorities have required that such fixtures be protected by thermostats which interrupt the flow of electricity to the lighting fixture lamp when it is overheated.

U.S. Pat. Nos. 4,131,868 and 4,396,898 disclose the use of thermal protectors in sockets of lamps. U.S. Pat. Nos. 4,216,411 and 4,460,944 disclose thermostats coupled to swimming pool lights.

U.S. Pat. No. 4,388,677 to Druffel represents the use of a thermal protector with a recessed lighting fixture.

U.S. Pat. Nos. 4,420,802 and 4,314,223 show specialized recessed lighting fixture thermal protectors which are adjacent recessed lighting fixtures.

A serious problem arises when insulation is blown into a ceiling or a wall after installation of recessed lighting fixtures. Such insulation surrounding a recessed lighting fixture will prevent the escape of heat from a recessed lighting fixture which may result in a fire.

Unfortunately, conventional thermal protectors for recessed lighting fixtures are not sufficiently sensitive to after-installed insulation. For example, thermal protectors of the type having insulation sensors mount to the junction box of a recessed lighting fixture and operate independently of the heat source, thereof. Such insulation sensors will not be tripped when insulation covers the heat generating portion of the lighting fixture but does not cover the insulation sensor.

Other thermal protectors, such as the one shown in U.S. Pat. Nos. 4,388,677 to Druffel, 4,420,802 and 4,314,223, attach to the housing of a recessed lighting fixture to sense the temperature of the fixture heat conduction. In addition, other potential hazardous conditions are detected by such heat conduction operated thermal protectors, such as mislamping or overlamping, which can result in the generation of excessive lighting fixture temperatures. However, these housing mounted thermal protectors possess a low safety factor (near 2° C.) often resulting in a nuisance tripping characteristic due to multiple demands on this type of thermal protection scheme. That is to say, the normal operating temperature of the lighting fixture raises the temperature of the housing mounted thermal protector to within 2° C. of a temperature which will trip the thermal protector, within tolerances.

A thermal protector that overcomes the shortcomings of the prior art would be a great advance in the lighting field.

SUMMARY OF THE INVENTION

In accordance with the present invention a novel and useful device for detecting the level of heat generated by a lighting unit is provided.

The device of the present invention utilizes a sleeve or tube possessing an end portion which is positioned adjacent to the exterior of the housing or reflector of a lighting fixture. In particular, the sleeve may be affixed to a recessed lighting fixture within a wall or ceiling. The sleeve also includes an interior portion and an exterior portion and may be constructed of heat insulating material such as plastic. The end portion of the sleeve is positioned adjacent the exterior of the housing or reflector surrounding the lamp of a lighting unit. In certain cases, the sleeve may contact such housing.

The present invention also includes thermal protector means for sensing the heat level adjacent the exterior of the lighting unit housing. A thermal protector mounts at the interior portion of the sleeve a selected distance from the exterior of the housing adjacent the end portion of the sleeve. The thermal protector is, of course, connected to the source of electrical power to the lighting unit lamp and interrupts the same when a selected temperature is exceeded at the thermal protector. The thermal protector means may also include a plate mounted at the interior portion of the sleeve between the thermal protector and the exterior of the housing adjacent the end portion of the sleeve. Such plate would be constructed of thermally conductive material in order to transfer heat to the adjacent thermal protector. In many cases, the thermal conductor means may touch one side of the plate. The other side of the plate may be coated, plated, or otherwise constructed of heat absorbing material. The heat absorbing side of the plate would receive radiation heat (and a lesser amount of convection heat) directly from the exterior of the lighting unit housing.

The device of the present invention may also possess means for permitting air circulation or ventilation between the exterior portion of the sleeve and the interior portion of the sleeve at the end portion of the sleeve adjacent the thermal protector means. Thus, air is permitted to enter the interior portion of the sleeve or chamber formed by the exterior of the lighting housing and the sleeve end portion. The operating range of the thermal protector means would be predetermined to prevent the electrical flow to the lamp of the lighting housing if the ventilation or air circulation means is clogged by blown-in insulation. In such a case, the thermal protector means would experience a sharp temperature increase during lamp operation.

To further sensitize the thermal protector means, a translucent partition may be interposed the thermal protector means and the exterior of the lighting unit housing at the interior portion of the sleeve. A greenhouse effect is achieved by translating short wavelength infrared radiation into longer wavelength infrared radiation by the use of such translucent partition.

It may be apparent that a novel and useful device for detecting the level of heat at a recessed lighting unit is provided.

It is an object of the present invention to provide a heat detection device which is very sensitive to the placement of blown-in insulation immediately adjacent a recessed lighting fixture within a wall or ceiling, a potentially dangerous situation.

It is another object of the present invention to provide a heat detection device which will protect a recessed lighting fixture against mis-lamping or overlamping of the lighting unit.

Another object of the present invention is to provide a heat detection device which primarily employs radiation heat for its operation.

A further object of the present invention is to provide a heat detection device which is mechanically compatible with existing recessed lighting units.

Yet another object of the present invention is to provide a heat detection device which possesses an increased safety factor over prior art devices to insure thermal protection of a lighting fixture.

Still another object of the present invention is to provide a heat detection device which is capable of reacting to a plurality of conditions causing overheating of a lighting fixture.

The invention possesses other objects and advantages especially as concerns particular characteristics and features thereof which will become apparent as the specification continues.

Figure 1:
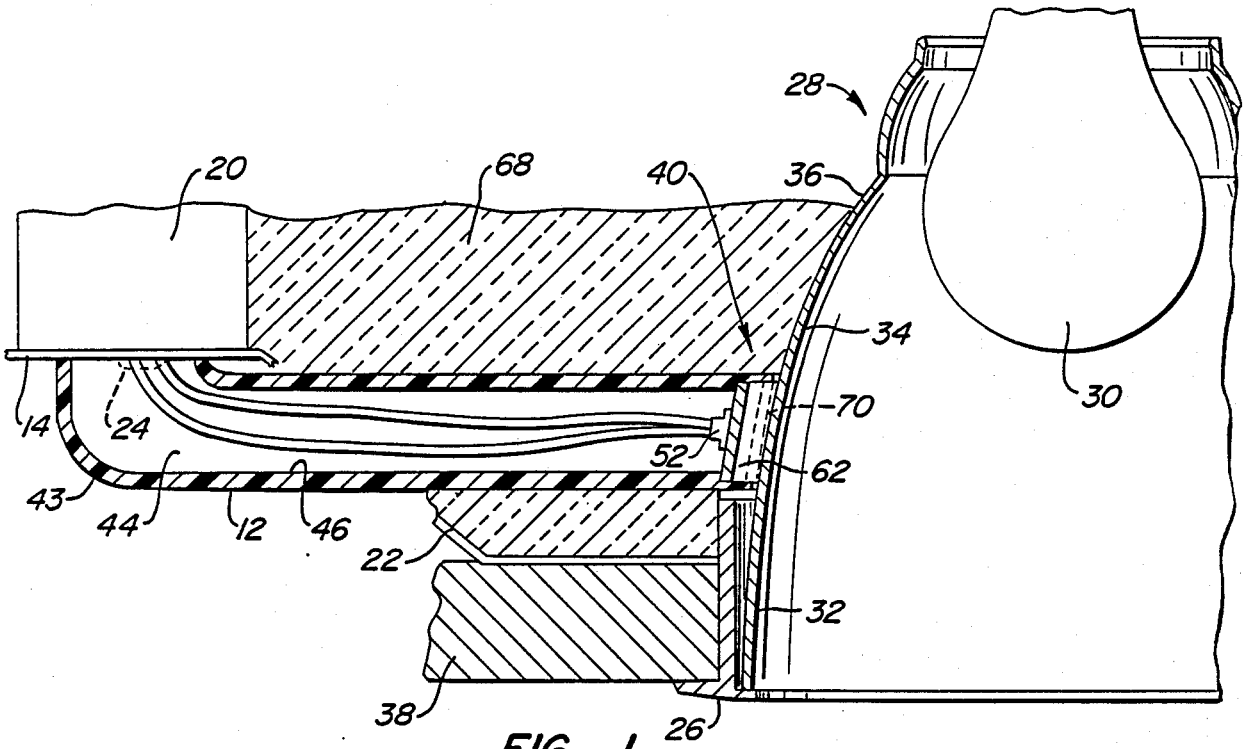
FIG. 1 is a sectional view depicting the heat detection device of the present invention in place with a typical recessed lighting fixture.

For a better understanding of the invention reference is made to the following detailed description of the preferred embodiments thereof which should be referenced to the herein above described drawings.

DESCRIPTION OF THE PREFERRED EMBODIMENTS

Various aspects of the present invention will evolve from the following detailed description of the preferred embodiments which should be referenced to the hereinabove described drawings.

The invention as a whole is identified in the drawings by referenced character 10. The heat detection device 10 includes as one of its elements a sleeve 12. Sleeve 12 may be constructed of thermally insulative materials such as plastic and the like. Sleeve 12 terminates in a flange 14 having ears 16 and 18 for connection to J-box 20. J-box 20 is normally supported to the structure or building in which device 10 is installed. A bracket 22 affixes to flange 14 by way of fastening means 24. Bracket 22 extends to and engages end piece 26 of lighting unit 28, FIG. 1.

Lighting unit 28 is depicted as being a recessed downlight having lamp 30 and a reflector or housing 32. Housing 32 includes an internal specular portion 34 and an exterior portion 36. Housing 32 extends approximately to the outer surface of wall or ceiling material 38.

Figure 2:
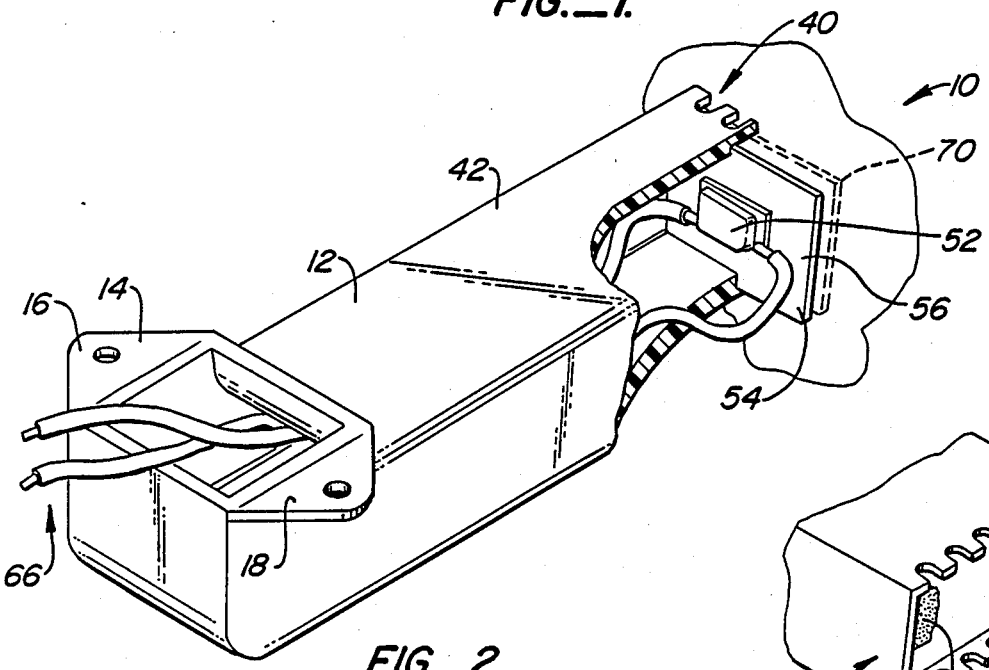
FIG. 2 is a top, front, right perspective view of the heat detection device of the present invention with a broken away portion in the vicinity of the thermal protector means.

Sleeve 12 includes end portion 40 which is positioned adjacent exterior 36 of housing 32. Sleeve 12 also includes an exterior portion 42 having surface 43 and an interior portion 44 having surface 45. End portion 40 of sleeve 32 contacts the exterior 36 of housing 32 although a gap therebetween may be tolerated. End portion 40 includes a multiplicity of slots 48 which are recessed from the end surface 46 of end portion 40. Multiplicity of slots 48 serve as means 50 for permitting air circulation between the exterior portion 42 and the interior portion 44 of sleeve 12, FIG. 2.

Figure 3:
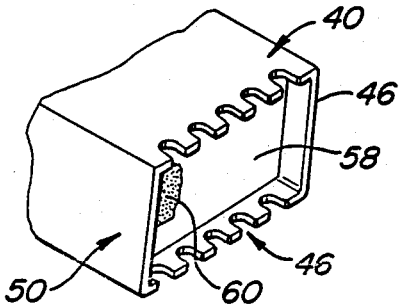
FIG. 3 is a broken top, right, rear perspective view of the sleeve employed in the present invention.

Device 10 is also provided with thermal protector means 52 which is mounted on a thermally conductive plate 54. Plate 54 includes a first surface 56 which contacts thermal protector means 52 and a second surface 58. Second surface 58 of thermally conductive plate 54 may be coated with darkened material, such as an anodized layer or paint layer 60, to aid in the absorption of heat from reflector housing 32. FIG. 3. Thermal protector means 52 may be mounted at the interior portion 44 of sleeve 12 without the use of plate 54. Thermal protector means 52 is fixed, in any case, a selected distance from the exterior 36 portion of reflector housing 32. Employment of plate 54 in device 10 forms a chamber 62 with interior surface 45 of the sleeve 12 and the exterior portion 36 of housing 32 framed by end surface 46 of end portion 40 of sleeve 12. Conductors 66 connect to the line voltage which feeds lamp 30 of recessed lighting unit 28. Thermal protector means 52 operates in the conventional manner by interrupting the flow of electricity to lamp 30 when a certain temperature is exceeded thereat.

FIG. 1 also depicts blown-in insulation 68 which is illustrated as surrounding the exterior 36 of housing 32. Typically, insulation 68 is positioned as shown in FIG. 1 after the installation of lighting unit 28. Since ceiling material 38 masks the area surrounding recessed lighting fixture 28, it is often not known that insulation 68 lies in abutment with housing 32.

In operation, sleeve 12 is positioned against housing 32 of lighting unit 28 such that end surface 46 of end portion 40 of sleeve 12 contacts exterior portion 36 of housing 32. Multiplicity of slots 48 permit air circulation through chamber 62 when insulation 68 is not existent. Heat radiated from the exterior surface 36 of housing 32 would pass through chamber 62 to surface 58 of plate 54. Heat would then be conducted to surface 56 of plate 54 and pass to thermal protector means 52. Thermal protector means 52 would possess an operating range such that any over-lamping of lighting unit 28 would activate thermal protector means 52, at this point. When insulation 68 is present, such insulation 68 would clog the multiplicity of slots 48 of end portion 40 of sleeve 12, but not enter into chamber 62. When this occurs, thermal protector means 52 would again stop the electrical flow to lamp 30 since the air ventilation through chamber 62 is not absent. Thus, thermal protector means 52 would detect the presence of insulation 68 in abutment with the exterior 36 of housing 32. It should be noted that the presents of insulation 68 as shown in FIG. 1 is a potential fire hazard.

A translucent plate 70 may also be placed within chamber 62 between plate 54 and exterior 36 housing 32. Radiation emanating from housing 32 within chamber 62 would pass through translucent plate 70 and be trapped between surface 58 of plate 54 and translucent partition 70, a "greenhouse" effect. It has been found that thermal protector means 52 and plate 54 receive heat from lighting unit 28 primarily by radiation which increases the sensitivity of thermal protector means 52 with or without blown-in insulation 68 lying next to lighting unit 28.

It should be further noted that plate 54 may be mounted in spaced relationship with exterior 36 of housing 32 without employing sleeve 12. Plate 54 would be spaced a relatively small distance from exterior 36 of housing 32 to preclude the insulation from interposing exterior 36 of housing 32 and surface 58 of plate 54. Thus, such placement of plate 54 serves as means 72 for preventing insulation 68 from substantially intercepting radiation heat passing from lighting unit 28 to thermal protector means 52.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A device for detecting the level of heat generated by a lighting unit including a housing surrounding a lamp energized by a source of electricity comprising:

a. a sleeve having an end portion positioned adjacent the exterior of the housing and positioned exterior to said housing, said sleeve further including an interior portion, and an exterior portion lying adjacent the exterior of the housing and lying exterior to said housing;

b. thermal protector means for sensing heat generated by the lighting unit at the exterior of the housing, said thermal protector means being mounted at the interior portion of said sleeve, a selected distance from the exterior of the housing adjacent said end portion of said sleeve; and c. means for permitting air circulation between said exterior portion of said sleeve lying adjacent and exterior to the exterior of the housing thereat and said interior portion of said sleeve at said end portion of said sleeve adjacent said thermal protector means.

2. A device for detecting the level of heat generated by a lighting unit in the presence of insulation including a housing surrounding a lamp energized by a source of electricity comprising:

a. thermal protector means for sensing the heat generated by the lighting unit at the exterior of the housing, said thermal protector means including means for collecting primarily radiation heat of the heat generated by the lighting fixture, said thermal protector means being mounted a selected distance from the exterior of the housing;

b. means for preventing the insulation from substantially intercepting radiation heat passing from the lighting unit to said radiation heat collecting means, said preventing means including a sleeve having an end portion positioned adjacent the exterior of the housing and positioned exterior to said housing, forming a chamber thereby, and means for permitting air circulation between said exterior of the housing immediately adjacent the sleeve end portion.

3. A device for detecting the level of heat generated by a lighting unit including a housing surrounding a lamp energized by a source of electricity comprising:

a. a sleeve having an end portion, positioned adjacent the exterior of the housing, an interior portion, and an exterior portion lying in close proximity to the exterior of the housing and lying exterior to the housing;

b. thermal protector means for sensing heat generated by the lighting unit at the exterior of the housing said thermal protector means being mounted at the interior portion of said sleeve, a selected distance from the exterior of the housing adjacent said end portion of said sleeve; and c. means for permitting air circulation between said exterior portion of said sleeve and said interior portion of said sleeve at said end portion of said sleeve adjacent said thermal protector means, said means for permitting air circulation between the exterior portion of said sleeve and said interior portion of said sleeve including at least one opening through said end portion of said sleeve between the exterior and interior of said sleeve.

4. The device of claim 3 in which additionally comprises a plate mounted at the interior portion of said sleeve between said thermal protector means and the exterior of the housing adjacent said end portion of said sleeve.

5. The device of claim 4 in which said plate is constructed of thermally conductive material and said thermal protector means being mounted in a heat transfer relationship with said plate.

6. The device of claim 3 in which said at least one opening includes a multiplicity of slots through said end portion of said sleeve between the exterior and interior of said sleeve.

7. The device of claim 4 in which said plate further includes a first side and a second side, said first side of said plate facing the exterior of the housing adjacent said end portion of said sleeve and including a surface of heat absorbing material, said second side of said plate contacting said thermal protector means.

8. The device of claim 3 which additionally comprises a translucent partition mounted at the interior portion of said sleeve and interposed the exterior of the housing adjacent said end portion of said sleeve and said thermal protector means.

9. The device of claim 8 which additionally comprises a plate mounted at the interior portion of said sleeve, interposed said translucent partition and said thermal protector means.

10. The device of claim 9 in which said thermal protector is mounted in heat transfer relationship with said plate.

11. The device of claim 10 in which said plate further includes a first side and a second side, said first side of said plate facing the exterior of the housing adjacent said end portion of said sleeve and including a surface of heat absorbing material, said second side of said plate contacting said thermal protector means.

12. The device of claim 11 in which said sleeve is constructed of heat insulating material.

* * * * *